US005697557A

United States Patent [19]

Blessing et al.

[11] Patent Number: 5,697,557

[45] Date of Patent: Dec. 16, 1997

[54] SHOWER HEAD WITH SWITCHING MECHANISM

[75] Inventors: Gerd Blessing, Villingen; Werner Finkbeiner, Schiltach, both of Germany

[73] Assignee: Hans Grohe GmbH & Co. KG, Germany

[21] Appl. No.: 431,446

[22] Filed: May 1, 1995

[30] Foreign Application Priority Data

May 5, 1994 [DE] Germany ..... 44 15 785.1

[51] Int. Cl.[6] ..... B05B 1/08

[52] U.S. Cl. ..... 239/447

[58] Field of Search ..... 239/443, 444, 239/445, 446, 447, 581.1, 380–383

[56] References Cited

U.S. PATENT DOCUMENTS

| | | | |
|---|---|---|---|
| 3,762,648 | 10/1973 | Deines et al. | 239/383 |
| 3,801,019 | 4/1974 | Trenary et al. | 239/383 |
| 4,081,135 | 3/1978 | Tomaro | 239/447 X |
| 4,561,593 | 12/1985 | Cammack et al. | 239/600 |
| 5,294,054 | 3/1994 | Benedict et al. | 239/446 X |
| 5,316,216 | 5/1994 | Cammack et al. | 239/447 X |
| 5,356,077 | 10/1994 | Shames et al. | 239/447 X |
| 5,398,872 | 3/1995 | Joubran | 239/446 X |
| 5,476,225 | 12/1995 | Chan | 239/383 X |

FOREIGN PATENT DOCUMENTS

| | | | |
|---|---|---|---|
| 817280 | 7/1949 | Germany . | |
| 1182155 | 7/1959 | Germany . | |
| 2329258 | 6/1973 | Germany . | |
| 2821195 | 5/1978 | Germany . | |
| 8906814.9 | 6/1989 | Germany . | |
| 2081607 | 2/1982 | United Kingdom | 239/383 |
| 2270859 | 3/1994 | United Kingdom | 239/447 |

*Primary Examiner*—Andres Kashnikow
*Assistant Examiner*—Steven J. Ganey
*Attorney, Agent, or Firm*—Eckert Seamans Cherin & Mellott

[57] ABSTRACT

A shower head contains a shower head core with a connection to a water main and a cup-shaped jacket surrounding the core. The jacket only frees the jet disk connected to the core. For switching between two groups of jet exit openings a switching element is provided, which is rotatably located in the shower head core and is rotated by rotating the shower head jacket with respect to the still stationary core and jet disk.

10 Claims, 1 Drawing Sheet

Fig. 1
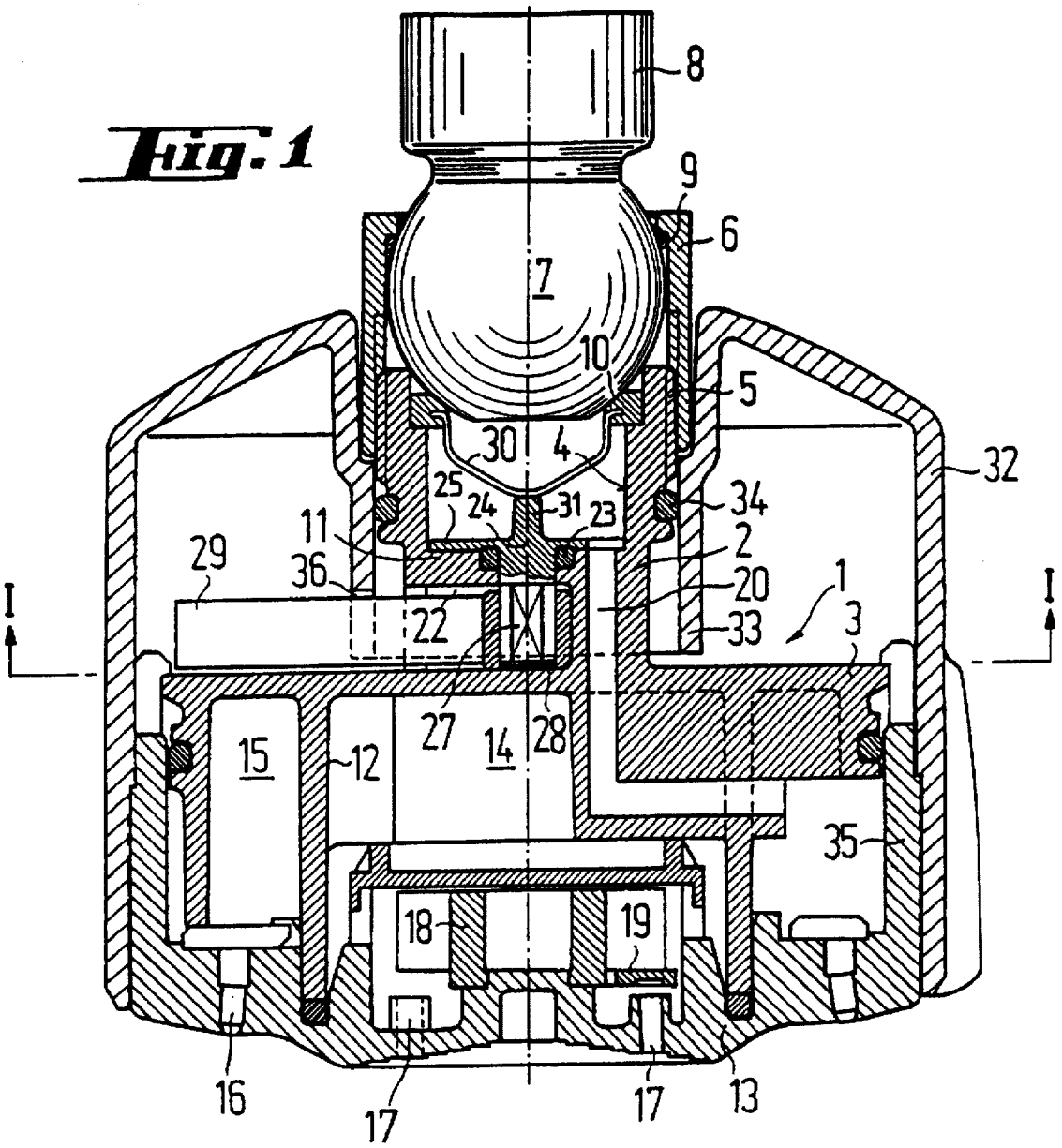
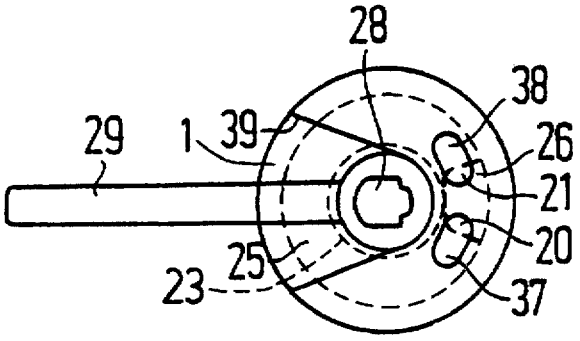
Fig. 2

SHOWER HEAD WITH SWITCHING MECHANISM

FIELD OF THE INVENTION

The invention relates to a shower head, particularly for a head shower, in which for switching or changing between different jet types the outside of the shower head casing is rotated.

BACKGROUND OF THE INVENTION

A shower head of this type is already known (U.S. Pat. No. 4, 561, 593) and contains a threaded connecting part and the actual shower head. For switching between two different jet types the entire shower head, including the jet disk is rotated. A switching mechanism located in the shower head remains stationary, whilst the jet disk with different control channels is rotated with respect to the switching mechanism.

A shower head with a switching mechanism is also known, in which the shower head part containing the jet disk and the different water ducts is rotated with respect to a base part (German patent 11 82 155).

In another known jet regulator (German patent 817 280) the entire shower head is rotated for switching purposes.

The problem of the invention is to provide a compact shower with two jet types, in which the switching mechanism has a very simple and easy-action construction.

SUMMARY OF THE INVENTION

Whereas in the prior art in shower heads of the aforementioned type there is always simultaneously a rotation of the jet disk, for the first time the invention provides a shower head of this type, in which the rotation of the shower head jacket does not lead to a rotation of the jet disk. Thus, switching can be made much simpler and with an easy-action.

According to a further development the switching element has a flat disk, which engages on a opposite face of the shower head core having control openings. The sealing of said disk with respect to the control openings takes place through the water pressure, so that there is a precise switching with the minimum effort.

For retaining the switching element prior to the operation of the shower head, according to the invention a spring can be provided, which still acts on the switching element or the flat disk if no water pressure has been applied. In particular, the disk can be flat and engages on a flat surface. The invention proposes that the switching element disk engages with its circumference on the inner wall of a cylindrical recess in the shower head core. As a result the disk can be rotated without a special bearing having to be provided.

According to the invention the switching element has a lug or tongue engaging through an opening of the shower head core and which is connectable downstream of the switching element with the operating member. The lug is preferably located in the rotation axis of the switching element. Thus, switching can be brought about by engagement on the lug and rotating the same.

For sealing purposes it is possible to provide a seal between the lug and the shower head core opening associated with the lug. Advantageously said seal is located further radially inwards than the openings of the channels leading to the groups of jet exit openings, so that as a result of the smaller surface and the favourable lever arm only slight frictional forces occur. Thus, the operation of the switching mechanism also has an easy action.

According to the invention the operating member is a roughly radially directed lever with an opening in its one end region in which engages the lug of the switching element.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIG. 1 A longitudinal section through a shower head according to the invention.

FIG. 2 Diagrammatically the view of the switching mechanism from below in FIG. 1.

DETAIL DESCRIPTION OF THE PREFERRED EMBODIMENTS

The shower head shown in section in FIG. 1 contains a shower head core 1, which contains a pin-like lug 2 to which is connected a transverse plate 3 Towards its free end the lug 2 contains a cylindrical recess 4. On its outside the lug 2 has in the end region an external thread 5 onto which is screwed a screw cap 6, which encloses a spherical part 7 of the connecting member 8. The screw cap 6 is sealed with respect to the spherical part 7 with the aid of a sealing ring 9 and the cylindrical lug 2 is sealed with respect to the spherical part 7 with the aid of an all-round seal 10.

The cylindrical recess 4 terminates in a planar, end face 11 of the transition between the lug 2 and the transverse plate 3. On its side remote from the lug 2 the transverse plate 3 contains a circular apron 12, which is spaced from the outer circumference of the transverse plate 3.

A jet disk 13 is fixed in spaced manner to the transverse plate 3. The transverse plate 3, the apron 12 and the jet disk 13 are so matched to one another that between them are formed two separate spaces, namely a central, first inner space 14 and an outer annular space 15.

For each of the two spaces the jet disk 13 has jet exit openings, namely an outer, concentric row of jet exit openings 16 for the outer annular space 15 and jet exit openings 17 for the inner space 14. On the inside of the jet disk 13 a rotor 18 is mounted in rotary manner in the inner space and to it can pass the water from said inner space 14 from the outside only and which is rotated by the water. The rotor 18 contains a closing disk 19, which alternately closes and opens the jet exit opening 17, so that a pulsating water jet is produced in the central part of the jet disk 13.

From the cylindrical recess 4 of the pin-like lug 2 of the shower head core 1 passes a channel 20 (cf. FIG. 1) initially axially and then radially into the outer annular space 15. A similar channel 21 not located in the sectional plane in FIG. 1 leads into the inner space 14. Both channels 20, 21 are radially spaced from the central axis of the shower head.

The end face 11 terminating the recess 4 contains an axial opening, which leads into a laterally open pocket of the cylindrical lug 2. In the vicinity of the connection point between said opening and the end face 11 is formed a shoulder, on which engages an O-ring 23 serving as the seal.

On the end face 11 is placed a switching element 24, which has a flat disk 25, which is planar in the represented embodiment. The disk is circular and has a notch 26 and engages flat on the end face 11. The external diameter of the disk 25 corresponds to the internal diameter of the cylindrical recess 4. On its underside in FIG. 1 the switching element 24 has a lug 27, which projects through the opening in the end face 11 and extends into the pocket 22. The O-ring 23 seals the lug 27, so that water cannot flow through the opening into the pocket 22.

The lug 27, which is not circular in its lower part, engages in an opening of the operating lever 29. The opening 28 of the lever 29 cross-sectionally corresponds to the cross-section of the lug 27. The lever 29 is connected in non-rotary manner to the switching element 24. A pivoting of the lever 29, cf. also FIG. 2, consequently leads to a rotation of the switching element 24.

In the sealing ring 10 is located a spring clip 30, which acts on a projection 31 on the top of the switching element 24 in FIG. 1. Thus, even if there is no water in the shower, the switching element is pressed against the end face 11, so that the switching element is already operational when the water supply is opened.

The shower head core 1 and the jet disk 13 are surrounded by a cup-shaped shower head jacket 32, which contains a central, sleeve-like part 33, with which it is mounted in rotary manner on the cylindrical lug 2, accompanied by the interposing of a slip ring 34 The jacket 32 is also mounted on the outside of the cylindrical edge 35 of the jet disk 13.

The sleeve-like part 33 of the shower head jacket 32 contains a notch 36, whose width roughly corresponds to the thickness of the lever 29. The lever 29 passes through said notch 36. If the shower head jacket 32 is rotated, the edges of the notch 36 move the operating lever 29, which by means of the lug 27 rotates the switching element 24.

FIG. 2 very diagrammatically shows the cooperation between the operating lever 29, the disk 25 of the switching element and the control openings 37, 38 into the channels 20, 21. In FIG. 2 the operating lever 29 is in a central position, where the notch 26 is so positioned that both control openings 37, 38 into the two channels 20, 21 are open. Water flowing in through the connecting member 8 into the shower head can consequently flow past the switching element into the two channels 20, 21 in the shower and leave the jet disk 13 through the two groups of jet exit openings 16, 17. If the lever is rotated clockwise in FIG. 2 the control opening 38 in the channel 21 is closed, so that the water can only flow through the channel 20 into the outer annular space 15. Conversely if the other channel is opened, then the operating lever 29 is pivoted counterclockwise.

Pivoting is possible to the extent permitted by the side walls 39 of the pocket 22 arranged in circular sector-like manner.

As a result of the sealing of the switching mechanism along a short length in the immediate vicinity of the rotation axis and radially within the control openings 38, 37 to the water flow ducts 20, 21, the switching element can be operated in a very easy action manner. On rotating the shower head jacket 32 for operating the switching element the jet disk remains in position, because it does not jointly rotate.

What is claim:

1. Shower head having a shower head core, which has a jet disk with at least two groups of jet exit openings and in each case a water duct to each group of jet exit openings, the jet disk being fixably mounted to the shower head core, a shower head jacket, which surrounds the shower head core and is rotatably mounted with respect to the latter, as well as with a switching mechanism, which has a switching element positioned transversely to the water flow direction and rotatable with respect to the shower head core, coupled to an operating member, which is connectable to the shower head jacket.

2. Shower head according to claim 1, wherein the switching element comprises a flat disk, which engages on an end face of the shower head core having control openings.

3. Shower head according to claim 1, wherein spring action is applied beforehand to the switching element.

4. Shower head according to claim 2, wherein the disk is planar.

5. Shower head according to claim 2, wherein a circumference of the disk engages on a inner wall of a cylindrical recess.

6. Shower head according to claim 1, wherein the switching element has a lug engaging through an opening in the shower head core and which is connectable downstream of the switching element to the operating member.

7. Shower head according to claim 6, wherein the lug is located in a rotation axis of the switching element.

8. Shower head according to claim 6, wherein a seal is placed between the lug of the switching element and the opening of the shower head core.

9. Shower head according to claim 8, wherein the core comprises control openings of channels leading to the groups of jet exit openings, wherein the seal is positioned radially within the control openings.

10. Shower head according to claim 6, wherein the operating member is a radially directed lever with an opening in the vicinity of its one end and in which engages the lug of the switching element.

* * * * *